US007954916B2

(12) United States Patent
Sugahara

(10) Patent No.: US 7,954,916 B2
(45) Date of Patent: Jun. 7, 2011

(54) DROPLET EJECTING APPARATUS FOR FORMING DOTS ON A MEDIUM

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 717 days.

(21) Appl. No.: 11/075,055

(22) Filed: Mar. 9, 2005

(65) Prior Publication Data

US 2005/0200647 A1 Sep. 15, 2005

(30) Foreign Application Priority Data

Mar. 10, 2004 (JP) ..... 2004-068175

(51) Int. Cl.
*B41J 29/38* (2006.01)

(52) U.S. Cl. ..... 347/9; 347/10; 347/11; 347/12

(58) Field of Classification Search ..... 347/12, 347/9, 10, 11
See application file for complete search history.

(56) References Cited

U.S. PATENT DOCUMENTS

| | | | | |
|---|---|---|---|---|
| 4,468,679 | A | 8/1984 | Suga et al. | |
| 6,164,748 | A * | 12/2000 | Taneya et al. | 347/15 |
| 6,276,774 | B1 * | 8/2001 | Moghadam et al. | 347/11 |
| 6,478,414 | B2 * | 11/2002 | Jeanmaire | 347/77 |
| 6,491,737 | B2 * | 12/2002 | Orme-Marmerelis et al. | 75/335 |
| 6,520,502 | B1 * | 2/2003 | Drouhard | 273/242 |
| 2002/0018082 | A1 * | 2/2002 | Hosono et al. | 347/1 |
| 2002/0024567 | A1 * | 2/2002 | Takagi | 347/72 |
| 2002/0085068 | A1 | 7/2002 | Jeanmaire | |
| 2002/0140774 | A1 * | 10/2002 | Miki et al. | 347/44 |
| 2004/0046825 | A1 | 3/2004 | Sugahara | |

FOREIGN PATENT DOCUMENTS

| | | | |
|---|---|---|---|
| EP | 0 895 864 | A2 | 2/1999 |
| EP | 1197335 | A1 * | 4/2002 |
| EP | 1 219 431 | A2 | 7/2002 |
| EP | 1 398 155 | A1 | 3/2004 |
| JP | A 57-185159 | | 11/1982 |
| JP | A 2-137933 | | 5/1990 |
| JP | A 6-286138 | | 10/1994 |
| JP | A-07-285222 | | 10/1995 |

(Continued)

OTHER PUBLICATIONS

Notice of Reasons for Rejection issued in Japanese Patent Application No. 2004-068175; mailed Feb. 23, 2010; with English-language translation.

(Continued)

*Primary Examiner* — Laura E Martin
(74) *Attorney, Agent, or Firm* — Oliff & Berridge, PLC

(57) ABSTRACT

An apparatus for ejecting droplets includes an actuator which applies ejection pressure to a pressure chamber which stores ink; a nozzle communicating with the pressure chamber and capable of ejecting a main droplet having a trajectory and a satellite droplet having a volume smaller than the main droplet together with the ejection of the main droplet; and a nozzle which communicates with the pressure chamber and ejects a main droplet having a trajectory intersecting the trajectory at a intersection point. The apparatus further includes a control device which controls the actuator and platen rollers transferring a paper. The control device performs control so that the main droplets collide with each other at the intersection point to form an united droplet and that the satellite droplet lands on the paper.

16 Claims, 12 Drawing Sheets

FOREIGN PATENT DOCUMENTS

| | | |
|---|---|---|
| JP | A-11-099651 | 4/1999 |
| JP | A-2001-239681 | 9/2001 |
| JP | A 2001-293886 | 10/2001 |
| JP | A-2002-154199 | 5/2002 |
| JP | A 2002-307686 | 10/2002 |
| JP | A-2004-122775 | 4/2004 |

OTHER PUBLICATIONS

Notice of Reasons for Rejection issued in Japanese Patent Application No. 2004-068175; mailed May 18, 2010; with English-language translation.

* cited by examiner

DROPLET EJECTING APPARATUS FOR FORMING DOTS ON A MEDIUM

BACKGROUND OF THE INVENTION

1. Field of the Invention

The present invention relates to an apparatus for ejecting droplets such as an ink-jet printer capable of ejecting very small droplets.

2. Description of the Related Art

In ink-jet printers, it is desired that each ink droplet to be ejected from a printing head is as small as possible in order to improve print quality. From this viewpoint, an existing ink-jet printing head is capable of ejecting small ink droplets of about 2 pico-liter (pl) by, for example, modifying a control pulse waveform for an actuator to apply ejection energy to ink, or decreasing the diameter of each nozzle.

In recent years, however, it is required to eject very small ink droplets of less than 2 pl to realize higher-quality, higher-resolution print. By the above-described technique of modifying a control pulse waveform or decreasing the diameter of each nozzle, however, it is difficult to further decrease the size of each ink droplet.

Other than the above-described techniques, there is known a technique to regulate a control pulse waveform and, at the same time, to regulate a distance between the nozzle and a print medium such that a main dot (a main ink droplet) and a satellite dot (a satellite ink droplet), both of which are ejected through a nozzle in accordance with one pressure variation, may have substantially the same volume and such that landing positions of those two ink droplets may be different from each other (see Japanese Patent Application Laid-open No. 7-285222 (FIG. 1)). By this technique, the size of the main ink droplet can be decreased, besides the satellite ink droplet can be increased in size and thus this can be a dot independent of the main dot.

However, for printing an image at a very high resolution having, e.g., photographic quality, it is required to eject ink droplets each smaller than those obtained by the above-described technique. In addition to the requirement of ejecting very small ink droplets, there is a requirement for an ink-jet printer to eject very small droplets of conductive paste so that a very fine electric circuit on a substrate can be printed.

U.S. Patent Application Publication No. US2004/0046825 A1, disclosed by the inventor, discloses an apparatus for ejecting very small droplets to form dots on a print medium, the apparatus characterized by including: a first droplet ejector capable of ejecting a first main droplet in a first trajectory and a satellite droplet smaller in volume than the first main droplet, the satellite droplet being ejected together with the first main droplet; a second droplet ejector capable of ejecting a droplet having a second trajectory intersecting the first trajectory; and a control unit for controlling the first and second droplet ejectors so that the first main droplet and the droplet ejected from the second droplet ejector collide to unite with each other and a united droplet flies in a trajectory different from the first trajectory and the satellite droplet lands on the print medium. In this apparatus, actuators are separately provided to drive the first and second droplet ejectors.

U.S. Pat. No. 6,167,748 (corresponding to Japanese Patent Application Laid-open No. 11-99651) discloses a liquid discharge method and apparatus which enables, for example, a gradation recording by ejecting two droplets respectively from first and second discharge ports and by colliding these droplets to unite with each other while these droplets are flying. The first and second discharge openings are provided with first and second flow paths which communicate therewith respectively, and first and second energy generating devices for discharging the droplets therefrom respectively. On the other hand, Japanese Patent Application Laid-open No. 2001-239681 discloses that a plurality of droplets discharged from a plurality of nozzles are made to unite with each other to land on a recording paper. Each of the plurality of nozzles communicates with a flow path provided with a heater.

SUMMARY OF THE INVENTION

A main object of the present invention is to provide an apparatus for ejecting droplets capable of ejecting very small droplets.

According to a first aspect of the present invention, there is provided an apparatus for ejecting droplets to form dots on a medium, the apparatus comprising: an ejection pressure applying section which applies ejection pressure to a storage chamber which stores liquid; a first nozzle which communicates with the storage chamber and which ejects a first main droplet in a first trajectory together with a satellite droplet having a volume smaller than the first main droplet; a second nozzle which communicates with the storage chamber and which ejects a second main droplet in a second trajectory intersecting the first trajectory at a predetermined intersection point; a control device which controls the ejection pressure applying section; and a medium holding device which holds the medium; wherein the control device controls the ejection pressure applying section so that the first main droplet and the second main droplet collide with each other at the intersection point to form a united droplet, and the satellite droplet, which has been ejected from the first nozzle, lands on the medium.

According to a second aspect of the present invention, there is provided an apparatus for ejecting droplets to form dots on a medium, the apparatus comprising: an ejection pressure applying section which applies ejection pressure to a storage chamber which stores liquid; a first nozzle which communicates with the storage chamber and which ejects a first main droplet in a first trajectory; a second nozzle which communicates with the storage chamber and which ejects a second main droplet in a second trajectory intersecting the first trajectory at a predetermined intersection point; a control device which controls the ejection pressure applying section so as to eject from the first nozzle the first main droplet and a satellite droplet which has a volume smaller than the first main droplet and which flies apart from the first main droplet, and to eject from the second nozzle the second main droplet which collides with the first main droplet at the intersection point to form a united droplet; and a print medium holding device which holds the medium at a position intersecting a trajectory of the satellite droplet.

According to the present invention, it is possible to make the satellite droplet (very small droplet), ejected together with the first main droplet and having a volume smaller than the first main droplet, land on the medium in order to form a very small dot. In addition, it is possible to constitute a droplet ejecting apparatus which allows the very small droplet to land on the medium with only one ejection pressure applying section. Accordingly, such an apparatus can be realized at a low cost.

In the present invention, a flying direction of the united droplet may be different from a flying direction of the satellite droplet ejected from the first nozzle. Accordingly, it is possible to form a dot on the medium only with the satellite droplet, without making the united droplet land on the medium.

In the present invention, a volume of the satellite droplet may be 0.002 to 0.5 pl. By adjusting the volume of the satellite droplet to this volume, it is possible to form an even smaller dot on the medium.

In the present invention, the first trajectory may be perpendicular to a surface of the medium held in the medium holding device. Accordingly, it is possible to form a circular dot on the medium, thereby improving the image quality.

In the present invention, an ejection port of the first nozzle and an ejection port of the second nozzle may be formed in a same plane. Accordingly, it is possible to easily form the first nozzle and the second nozzle, thereby decreasing the cost for manufacturing the droplet ejecting apparatus.

In the present invention, a first plane in which an ejection port of the first nozzle is formed and a second plane in which the second nozzle is formed may be planes intersecting with each other; and the first nozzle may be formed so that an axis line of the first nozzle extends along the first trajectory, and the second nozzle may be formed so that an axis line of the second nozzle extends along the second trajectory. Accordingly, it is possible to form the first nozzle and the second nozzle so that the ejection characteristics are stabilized and the satellite droplet, the first and second main droplets are ejected with high precision.

In addition, in the present invention, a nozzle diameter of the first nozzle at an ejection port thereof and a nozzle diameter of the second nozzle at an ejection port thereof may be different. Accordingly, it is possible to prevent the second nozzle from ejecting excess satellite droplets, thereby preventing the inconvenience that the medium is stained with the excess satellite droplets.

Further, in the present invention, a nozzle diameter of the first nozzle at an ejection port thereof may be smaller than a nozzle diameter of the second nozzle at an ejection port thereof; and a linear distance between the ejection port of the first nozzle and the intersection point may be longer than a linear distance between the ejection port of the second nozzle and the intersection point. Accordingly, it is possible to eject the satellite droplet from the first nozzle, to prevent the second nozzle from ejecting any satellite droplet, and to make the first main droplet and the second main droplet collide with each other.

Furthermore, in the present invention, a following expression may be held when the control device drives the ejection pressure applying section: $L1/V1=L2/V2$; wherein $L1$ is a linear distance between an ejection port of the first nozzle and the intersection point; $L2$ is a linear distance between an ejection port of the second nozzle and the intersection point; $V1$ is an ejection speed of the first main droplet ejected from the first nozzle; and $V2$ is an ejection speed of the second main droplet ejected from the second nozzle. Accordingly, it is possible to ensure that the first and second main droplets collide with each other.

In the present invention, an ejection speed of the first main droplet ejected from the first nozzle may be not less than 4.5 m/sec and less than 7.0 m/sec; and an ejection speed of the second main droplet ejected from the second nozzle may be less than 4.5 m/sec. Accordingly, it is possible for the first nozzle to eject a desired satellite droplet, and for the second nozzle not to eject any satellite droplet.

In the present invention, an ejection port of the first nozzle may have a circular or elliptic shape; and a trajectory of the satellite droplet may be same as the first trajectory. Accordingly, it is possible to eject the satellite droplet with high precision.

In the present invention, an ejection port of the first nozzle may have a circular or elliptic shape in which a notch is formed in a portion of outer edge thereof; and a trajectory of the satellite droplet may be tilted toward the notch from the first trajectory. Accordingly, the satellite droplet and the second main droplet hardly collide with each other, because the satellite droplet will not pass through the intersection point.

In the present invention, a droplet catching section for catching the united droplet may be disposed in a trajectory of the united droplet. Accordingly, the united droplet will never land on the medium and thus no excessive dots will be formed.

In the present invention, the apparatus may further comprise a discharge passage for discharging the united droplet which has been caught in the droplet catching section. Accordingly, it is possible to discharge the liquid held by the droplet catching section, thereby decreasing the volume of the droplet catching section.

In the present invention, the apparatus may further comprise a liquid chamber for supplying the liquid to the storage chamber; and a delivery passage for delivering the united droplet which has been caught in the droplet catching section to the liquid chamber. Accordingly, it is possible to recycle the united droplet and thus reduce the running cost.

In the present invention, the delivery passage may suck up the united droplet to the liquid chamber by capillary force. Accordingly, it is possible to suck up the united droplet with a simple constitution with high efficiency.

According to a third aspect of the present invention, there is provided a droplet-ejecting head which forms dots on a medium, the droplet-ejecting head comprising: an ejection surface in which a first nozzle and a second nozzle are formed, the second nozzle having an ejection direction different from an ejection direction of the first nozzle; a pressure chamber which is common to the first nozzle and the second nozzle, and which stores liquid to be ejected from the first nozzle and the second nozzle; and an actuator which applies ejection pressure to the pressure chamber. Since this droplet-ejecting head includes a pressure chamber and an actuator common to the first nozzle and the second nozzle, it is possible to practice the printing method as disclosed in U.S. Patent Application Publication No. US 2004/0046825 A1 with a much simpler construction. The first and second nozzles may be formed to be tilted from a direction perpendicular to a surface of a nozzle plate. In addition, a nozzle diameter of the first nozzle may be different from a nozzle diameter of the second nozzle.

DESCRIPTION OF THE PREFERRED EMBODIMENTS

Figure 1:
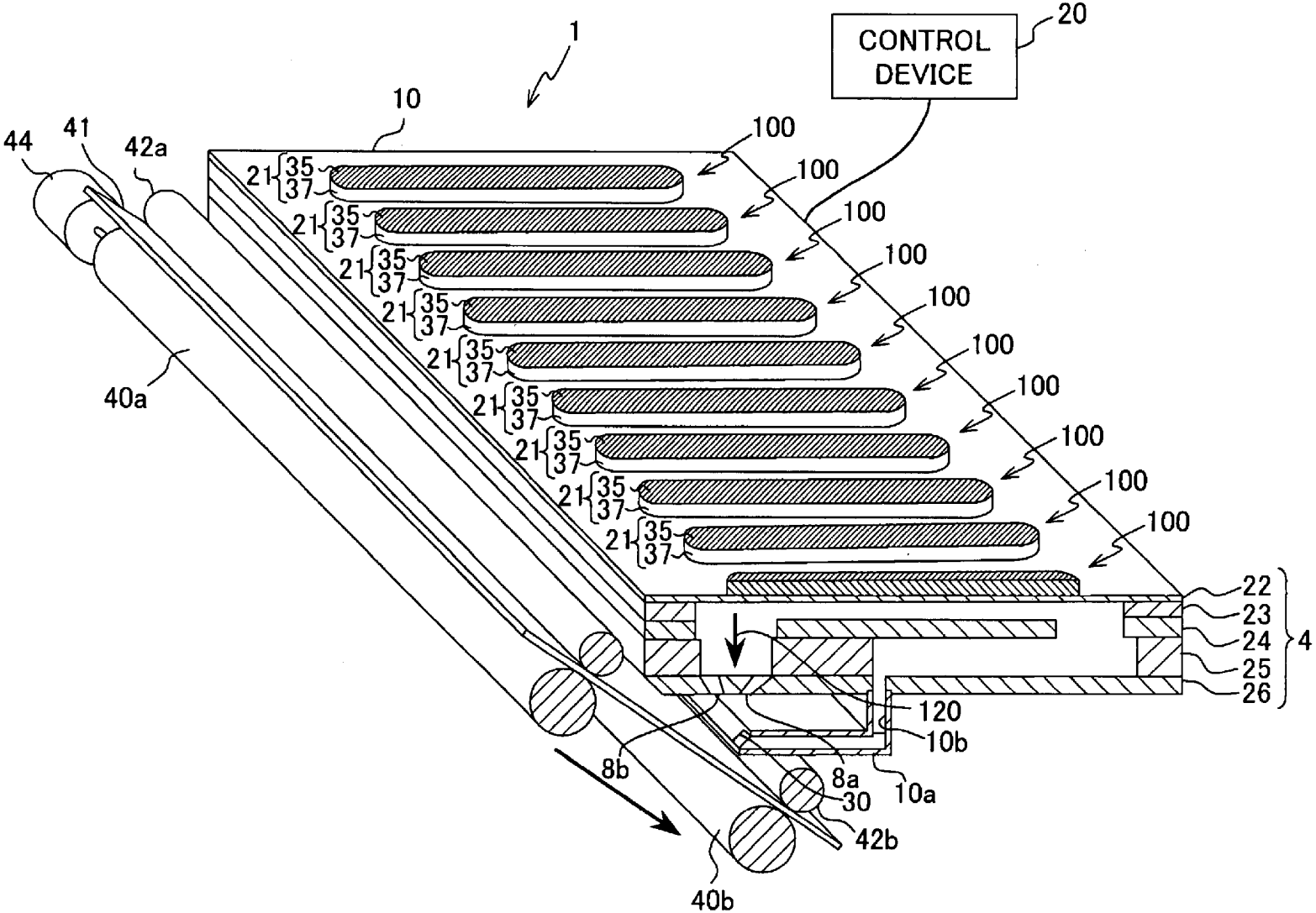
FIG. 1 shows a perspective view illustrating a schematic arrangement of an ink-jet printer including an ink ejecting section according to a first embodiment of the present application.

A first embodiment of the present invention will be explained with reference to the drawings. FIG. 1 shows a perspective view illustrating a schematic arrangement of an ink-jet printer including an ink ejecting section according to the first embodiment. For sake of explanation, FIG. 1 shows the ink-jet printer in a state in which a part of the printer is cut open. As shown in FIG. 1, an ink-jet printer 1 includes therein platen rollers 40*a*, 40*b* as a transport means which transports a paper 41 as a medium and as a medium holding means (device) which holds the paper 41 at a recording position; guide rollers 42*a*, 42*b* which hold the paper 41 therebetween together with the platen rollers 40*a*, 40*b*; an ink-jet head 10 which ejects ink droplets onto the paper 41 transported by the transport means; and a control device 20.

The platen rollers 40*a*, 40*b* are attached to a non-illustrated frame so as to be rotatable. The platen rollers 40*a*, 40*b* are driven by an electric motor 44 to rotate. The paper 41 is fed from a non-illustrated paper feed cassette provided in one side portion of the ink-jet printer 1. The paper 41 is then transported by the platen rollers 40*a*, 40*b* at a constant speed. After printing is performed on the paper 41 with ink ejected from the ink-jet head 10, the paper 41 is discharged from the ink-jet printer 1.

In FIG. 1, a detailed illustration of the mechanism for feeding and discharging the paper 41 is omitted. The ink-jet printer 1 of FIG. 1 is a monochrome printer and thus includes only one ink-jet head 10. In the case a color printing is performed with the ink-jet printer 1, at least four ink-jet heads 10 for yellow, magenta, cyan, and black are provided in parallel.

The ink-jet head 10 is a line head extending perpendicularly to the transport direction of the paper 41. The ink-jet head 10 is fixed to the frame so as to oppose to the paper 41 at a predetermined angle. A large number of nozzles 8*a*, 8*b*, which eject ink droplets on the basis of control of the control device 20, are arranged in a row in an ink-ejection surface (lower surface) of the ink-jet head 10 along the longitudinal direction of the ink-jet head 10. In addition, the nozzles 8*a* and 8*b* are arranged side-by-side in a row so as to be along the widthwise direction of the ink-jet head 10. The nozzle 8*a* is formed so that the trajectory (first trajectory) of an ink droplet ejected from the nozzle 8*a* is substantially perpendicular to the paper 41, and the nozzle 8*b* is formed so that the trajectory (second trajectory) of an ink droplet ejected from the nozzle 8*b* intersect the trajectory of the ink droplet ejected from the nozzle 8*a* at a predetermined angle. A large number of actuators 21, which is controlled by the control device 20 for making nozzles 8*a*, 8*b* eject ink droplets, are arranged in a row on a surface (upper surface) opposite to the ink-ejecting surface of the ink-jet head 10 along the longitudinal direction of the ink-jet head 10. In the ink-jet head 10, a large number of ink ejecting sections 100 are arranged along the extending direction of the ink-jet head 10. Each of the ink ejecting sections 100 includes a pair of nozzles 8*a*, 8*b*, one individual ink flow path 120 which communicates with the nozzles 8*a*, 8*b*, and one actuator 21. In addition, in the ink-ejecting surface of the ink-jet head 10, a projection 10*a* is arranged. The projection 10*a* extends along the extending direction of ink-jet head 10, and is an L-shaped in cross section in the widthwise direction thereof.

The control device 20 controls the operations of parts or components of the ink-jet printer 1, such as the electric motor 44 and the ink-jet head 10. Particularly in this embodiment, the control device 20 perform control, in accordance with one ink ejection signal (which means a drive pulse corresponding to one dot on the paper 41), so that the nozzle 8*a* ejects a main droplet (first main droplet) 61 having a relatively large diameter (for example, a diameter of about 4 to 25 μm) and a satellite droplet 63 which is smaller in volume than the main droplet 61 (for example, having a diameter of about 1.6 to 10 μm) after the ejection of the main droplet 61, and at the same time, the nozzle 8*b* ejects only one main droplet (second main droplet) 62. It is considered that the main droplet 61 ejected from the nozzle 8*a* and the main droplet 62 ejected from the nozzle 8*b* collide with each other to form a united droplet 64 which has a trajectory different from that of the main droplet 61 (see FIG. 2). Further, the ejection speed and the volume of the ink droplets can be controlled by adjusting at least one of the pulse height, the number of pulses, the pulse width of the ink ejection signal or the like on the basis of the dimension of the ejection port of nozzles 8*a*, 8*b*.

Figure 2:
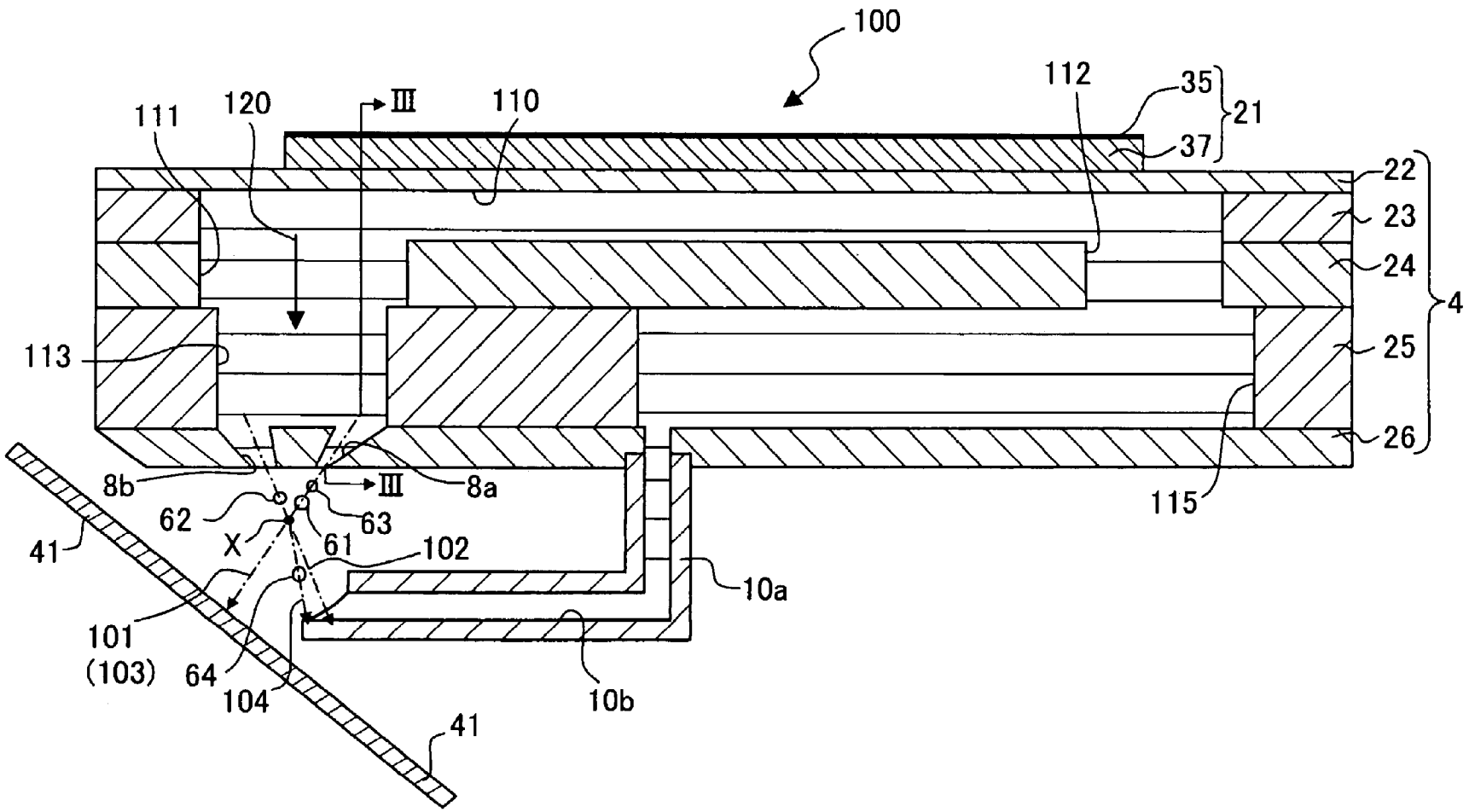
FIG. 2 shows a sectional view illustrating the ink ejecting section shown in FIG. 1.
Figure 3:
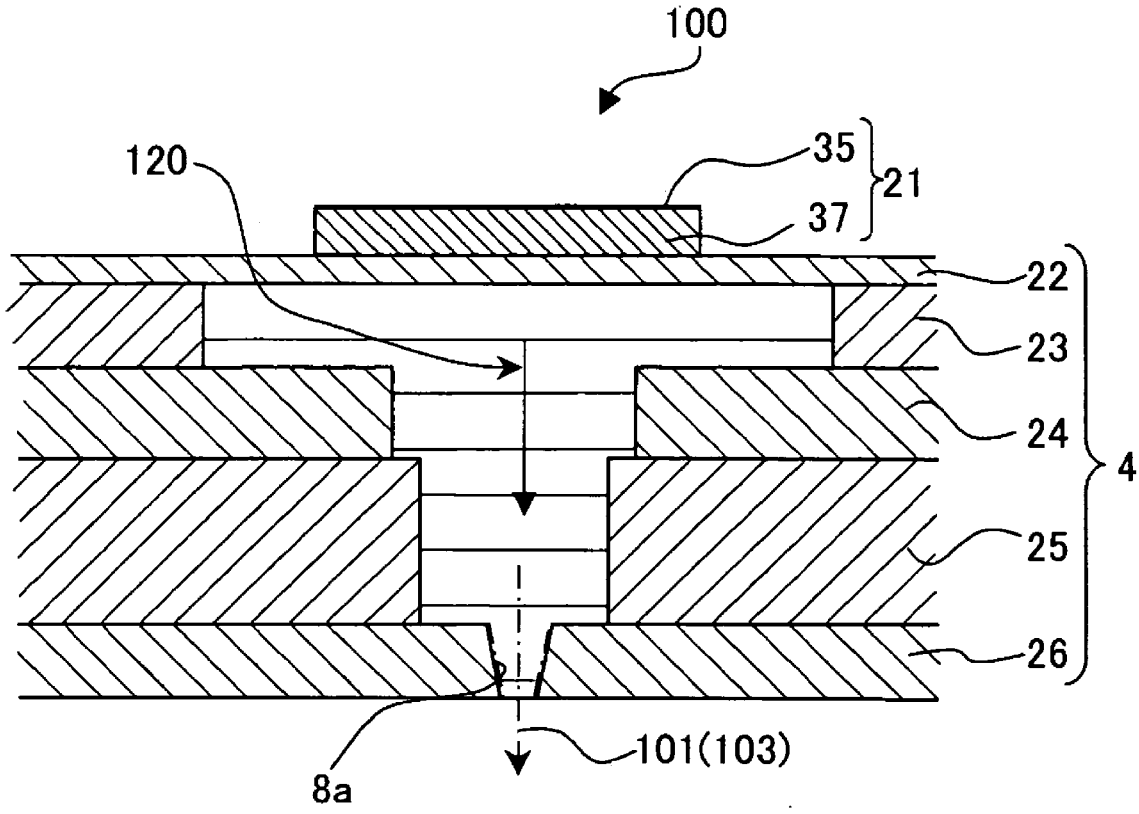
FIG. 3 shows a sectional view illustrating the ink ejecting section taken along a line III-III shown in FIG. 2.

Next, an internal structure of the ink-jet head 10 will be explained with reference to FIGS. 2 and 3. FIG. 2 shows a sectional view illustrating the ink ejecting section 100 in the ink-jet head 10. FIG. 3 shows a sectional view illustrating the ink ejecting section 100 taken along a line III-III shown in FIG. 2. As shown in FIGS. 2 and 3, in the ink-jet head 10, an actuator 21, which is driven with a drive pulse signal (which can take selectively one of the ground potential and a predetermined positive potential) generated in a non-illustrated drive circuit, and a flow path unit 4 forming an individual ink flow path are stacked in layers. The actuator 21 and flow path unit 4 are bonded to each other with an epoxy-base thermocurable adhesive. For applying the drive pulse signal generated in the non-illustrated driving circuit, a flexible printer wiring board (not illustrated) is bonded to the upper surface of the actuator 21. In addition, the ink-ejection surface of the flow path unit 4 is fitted with an edge of the projection 10*a* in a perpendicular direction.

The flow path unit 4 is constructed by stacking in layers: four thin-shaped plates formed of a metal material (an actuator plate 22, a cavity plate 23, a supply plate 24, and a manifold plate 25); and a nozzle plate 26 which is formed of a synthetic resin such as polyimide and which includes nozzles

8*a*, 8*b* for ejecting an ink. The actuator plate 22 in the uppermost layer is in contact with the actuator 21.

On the surface of the cavity plate 23, a plurality of pressure chambers 110 are formed for storing ink to be selectively ejected by an action of the actuator 21. The pressure chambers 110 are arranged in a row along the longitudinal direction of the ink-jet head 10 (a direction perpendicular to the sheet surface of FIG. 2, and in a direction parallel to the sheet surface of FIG. 3).

In the supply plate 24, connection holes 111 for connecting one ends of the pressure chambers 110 to the respective nozzles 8*a*, 8*b* and connection holes 112 for connecting the other ends of the pressure chambers 110 to a manifold passage 115 (to be explained later) are formed so as to be arranged in a row along the longitudinal direction of the ink-jet head 10.

In the manifold plate 25, connection holes 113 for connecting one ends of the pressure chambers 110 to the respective nozzles 8*a*, 8*b* are formed. Further, in the manifold plate 25, a manifold passage 115 for supplying ink to the pressure chambers 110 is formed. The manifold passage 115 is formed in a lower portion of the row constituted by the plurality of pressure chambers 110 to extend along the row direction. One end of the manifold passage 115 is connected to a non-illustrated ink supply source.

The nozzles 8*a*, 8*b* are formed in the nozzle plate 26. Thus, in the ink-jet head 10, a large number of the individual ink flow paths 120 are formed so as to be arranged in the extending direction of the ink-jet head 10. Each of the individual ink flow paths 120 is formed to extend from the manifold passage 115 through the connection hole 112, the pressure chamber 110, the connection hole 111, and the connection hole 113 to extend to the nozzles 8*a*, 8*b*. The nozzles 8*a*, 8*b* are both formed to be tilted from a direction perpendicular to the surface of the nozzle plate 26, and the tilt angle of the nozzle 8*a* is different from the tilt angle of the nozzle 8*b*. The tilt angles of the nozzles 8*a*, 8*b* with respect to the direction perpendicular to the surface of nozzle plate 26 may be from 30 to 60 degrees. Specifically, the nozzle 8*a* is formed so that a linear trajectory (first trajectory) 101 of the main droplet 61 and a linear trajectory (third trajectory) 103 of the satellite droplet 63 are substantially perpendicular to the surface of the paper 41. The nozzle 8*b* is formed so that a linear trajectory (second trajectory) 102 of the main droplet 62 intersects the trajectory 101 at a intersection point X between the nozzle 8*a*, 8*b* and the paper 41 (see FIGS. 1 and 2). It is considered that trajectory 101 is on the central axis of the nozzle 8*b*, and that the trajectory 102 is on the central axis of the nozzle 8*b*. In addition, in the nozzle plate 26, a recess, to which the edge of the projection 10*a* communicating with an ink catching section 30 is fitted, is formed so as to extend in the longitudinal direction of the ink-jet head 10. In the bottom surface of the recess, a large number of holes are formed for communicating with the manifold passage 115.

The projection 10*a* includes a capillary ink flow path 10*b* having a L-shaped form and formed to extend from one end through the other end of the projection 10*a* in the widthwise direction thereof. A large number of the capillary ink flow paths 10*b* are arranged in a row along the longitudinal direction of the projection 10*a*. When the projection 10*b* is fitted to the recess formed in the ink-ejection surface of the nozzle plate 26, the hole formed in the bottom surface of the recess for communicating with the manifold passage 115 and one end of the capillary ink flow path 10*b* are connected to each other. In an open end of the capillary ink flow path 10*b*, which is disposed on a side opposite to the one end, the ink catching section 30 is formed.

The ink catching section 30 is arranged in a trajectory 104 of the united droplet 64 between the paper 41 and the intersection point X, and the ink catching section 30 catches or receives the united droplet 64 flying in the trajectory 104. In the trajectory 104, a lower edge portion and an upper edge portion of the ink catching section 30 protrude toward the nozzles 8*a*, 8*b*, with the lower edge portion protruding more prominently toward the side of nozzles 8*a*, 8*b* compared with the upper edge portion. The protruded area serves as an area for receiving the united droplet 64. When the ink catching section 30 receives the united droplet 64, the capillary ink flow path 10*b* sucks up and delivers the ink of united droplet 64 to the manifold passage 115. The capillary ink flow path 10*b* may be arranged so that the ink, which has been sucked, is discharged to another discharge position which is prepared separately.

The actuator 21 is arranged to correspond to the associated pressure chamber 110 and has a stacked structure in which an individual electrode 35 and a piezoelectric sheet 37 are stacked in layers. The piezoelectric sheet 37 is formed of a ceramic material based on lead zirconate titanate (PZT) having ferroelectricity, and the lower sheet of the piezoelectric sheet 37 is adjacent to the actuator plate 22 which serves as an upper wall of the pressure chamber 110. The actuator plate 22 is always kept at the ground potential, and functions as a common electrode which is common to the large number of ink ejecting sections 100. The individual electrode 35 has a surface shape which is same as that of the piezoelectric sheet 37 (see FIG. 1). In addition, the individual electrode 35 is formed of a material based, for example, on Ag—Pd, and is connected to a non-illustrated flexible wiring board. The control device 20 is capable of controlling a drive pulse signal to be supplied to the individual electrode 35 via the flexible wiring board.

The piezoelectric sheet 37 is polarized in the thickness direction thereof. Accordingly, when the control device 20 applies a potential higher than the ground potential to the individual electrode 35, an electric field is applied to the piezoelectric sheet 37 in the polarization direction thereof. When the electric field is applied to the piezoelectric sheet 37, a portion thereof, to which the electric field is applied, functions as an active portion and expands in the thickness direction thereof and at the same time, attempts to contract in the plane direction thereof by a transversal piezoelectric effect. Accompanying this phenomenon, the piezoelectric sheet 37 and the actuator plate 22 deform so as to project toward the pressure chamber 110 (a unimorph deformation). That is, a drive mechanism of unimorph type is realized in the actuator 21.

Figure 4A:
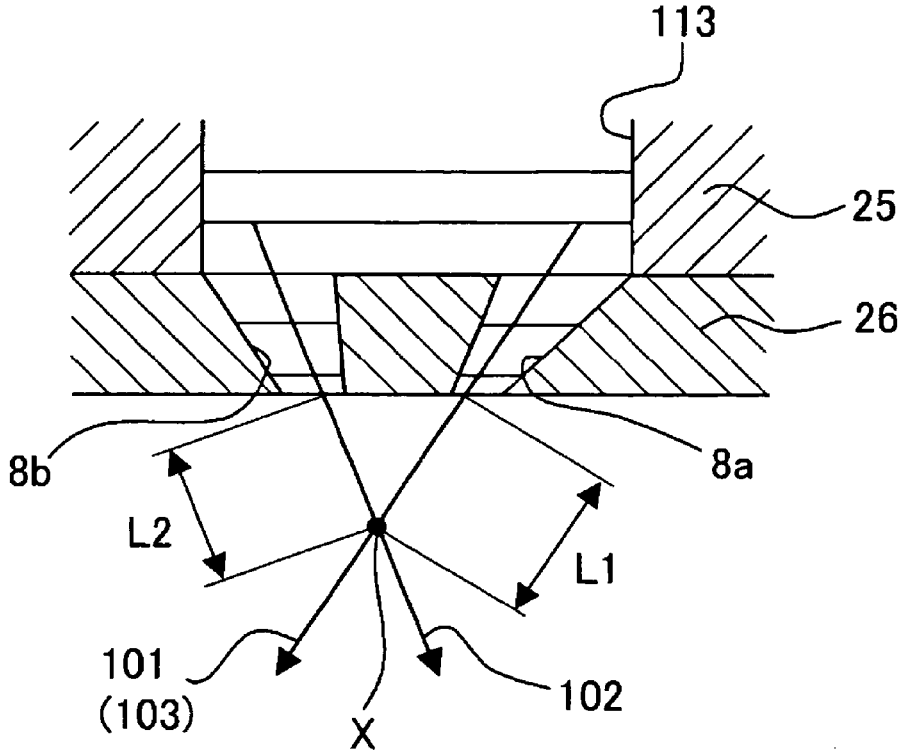
FIGS. 4A and 4B show a magnified view of nozzles shown in FIG. 3.
Figure 4B:
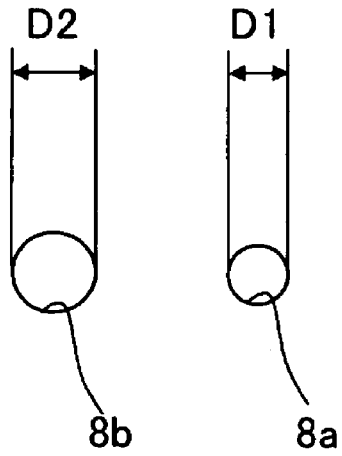

Next, the construction of the nozzles 8*a*, 8*b* will be explained in detail with reference to FIG. 4 (FIGS. 4A and 4B) showing a magnified view of the nozzles 8*a*, 8*b*. FIG. 4A shows a sectional view of nozzles 8*a*, 8*b*, and FIG. 4B shows an outline view of the nozzles 8*a*, 8*b* viewed from an ink ejection surface (viewed from the side of ink ejection ports of nozzles 8*a*, 8*b*). As shown in FIG. 4A, the ejection ports of nozzles 8*a*, 8*b* have a circular shape and are formed in a same plane. Further, a linear distance L1 from the ejection port of nozzle 8*a* to an intersection point X is longer than a liner distance L2 from the ejection port of nozzle 8*b* to the intersection point X. As shown in FIG. 4B, a diameter D1 which is a diameter of the ejection port of nozzle 8*a* is smaller than a diameter D2 which is a diameter of the ejection port of nozzle 8*b*. In other words, a dimension of opening of the ejection port of nozzle 8*a* is smaller than a dimension of opening of the ejection port of nozzle 8*b*. The ejection characteristics of ink droplet, when a same ejection pressure is applied thereto, are follows: as the opening dimension of ejection port is smaller, the ejection speed of ink droplet becomes grater, and as the opening dimension of ejection port is greater, the ejection speed of ink droplet becomes smaller. Namely, in this embodiment, an ejection speed V1 of a main droplet 61 in the nozzle 8*a* is greater than an ejection speed V2 of a main droplet 62 in the nozzle 8*b*. Further, in order to eject the main droplets 61, 62 simultaneously and in a substantially linear manner, and to make the main droplets 61, 62 collide with each other at the intersection point X, the following relationship is held: L1/V1=L2/V2.

Figure 5:
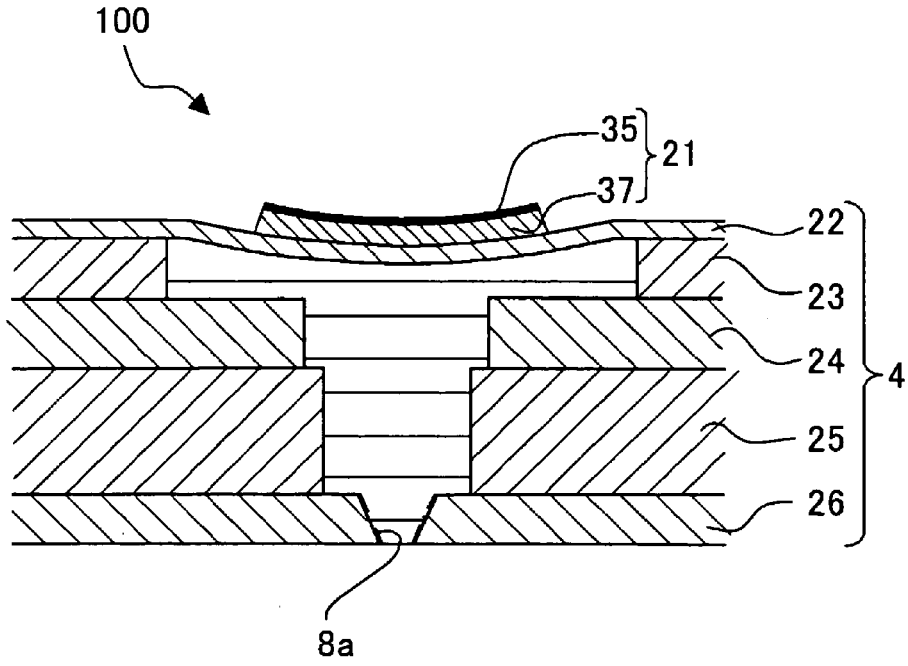
FIG. 5 shows a sectional view of an actuator in the ink ejecting section shown in FIG. 1, when the actuator is driven.
Figure 6A:
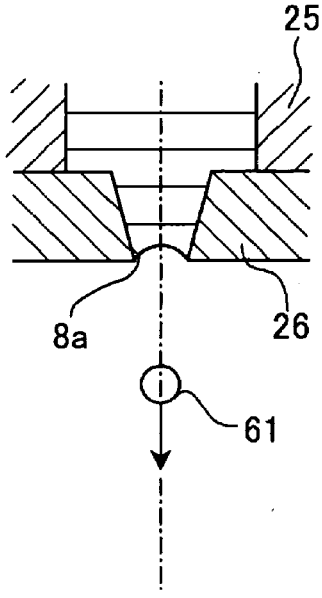
FIGS. 6A to 6C are diagrams respectively illustrating states of ink droplets ejected from the nozzle shown in FIG. 3.
Figure 6B:
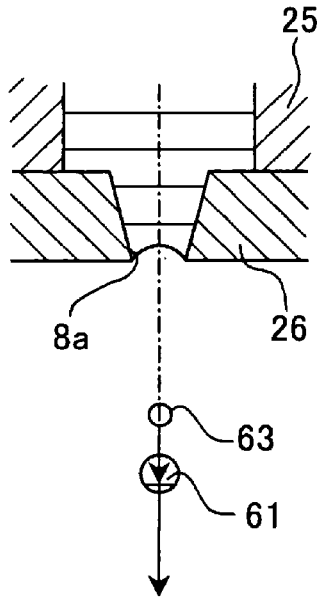
Figure 6C:
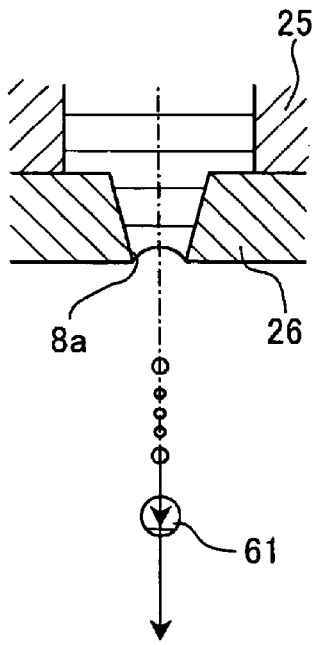

Next, the operation of ink ejecting section 100 will be explained with reference to FIGS. 5 and 6. FIG. 5 shows a sectional view of the ink ejecting section 100 when the control device drives the actuator 21. FIG. 6 (FIGS. 6A to 6C) is a diagram showing states in which ink droplets are ejected from the nozzle 8*a*. First, the control device 20 applies a predetermined potential to the individual electrode 35 in advance so that the actuator 21 and the actuator plate 22 adjacent thereto swell into (deform to project toward) the pressure chamber 110. Then, every time the control device 20 receives a command to perform ejection, the control device 20 lowers the potential applied to the ground potential once so that the actuator 21 and the actuator plate 22 adjacent thereto have a flat shape (see FIG. 3). After that, the control device applies the predetermined potential to the actuator 21 and the actuator plate 22 adjacent thereto again in a predetermined timing so that the actuator 21 and the actuator plate 22 adjacent thereto swell into the pressure chamber 110.

In this manner, the control device 20 makes the volume of the pressure chamber 110 reverse back from the decreased state to the state prior to the volume has been decreased, thereby generating a negative pressure within the pressure chamber 110, which in turn causes the pressure chamber 110 suck up the ink from the manifold passage 115. Further, the control 20 decreases the volume of the pressure chamber once again, thereby generating a positive pressure within the pressure chamber 110, which in turn causes the ink in the pressure chamber 110 to be ejected from the nozzle 8*a*, 8*b* simultaneously. Namely, this means that the control device 20 applies a drive pulse signal of square-wave to the individual electrode 35 so as to eject the ink droplets simultaneously from the nozzles 8*a*, 8*b*. A pulse width of the drive pulse is an AL (Acoustic Length) that is a time length required for a pressure wave to propagate from the manifold passages 115 toward the nozzles 8*a*, 8*b* in the pressure chamber 110, and when the interior of the pressure chamber 110 is reversed from the negative-pressure state to the positive-pressure state, the positive pressures and the negative pressure are superimposed on each other. Accordingly, it is possible to make the nozzles 8*a*, 8*b* to simultaneously eject the ink droplets therethrough by a strong pressure.

In this embodiment, whether or not a satellite droplet 63 is ejected depends on the ejection speed. As an example, in a case an ink having a viscosity of 5 cp and a surface tension of 40 mN/m is ejected and when the ejection speed of ink droplet is less than 4.5 m/sec, no satellite droplet 63 is ejected, as shown in FIG. 6A. On the other hand, when the ejection speed of ink droplet is not less than 4.5 m/sec and less than 7.0 m/sec, a desired satellite droplet 63 is ejected, as shown in FIG. 6B. At this time, the satellite droplet 63 flies so as to follow a main droplet 61 in a trajectory same as that of a main droplet 61 and at a speed lower than that of the main droplet 61. This means that a trajectory 101 of the main droplet 61 and a trajectory 103 of the satellite droplet 63 are same. However, when the ejection speed of ink droplet is more than 7.0 m/sec, a large number of unstable satellite droplets are ejected. As explained above, it is preferable in this embodiment that the control device 20 performs control so that the ejection speed of ink droplet from the nozzle 8*a* is not less than 4.5 m/sec and less than 7.0 m/sec and the ejection speed of ink droplet from nozzle 8*b* is less than 4.5 m/sec. As described above, this ejection speed of ink droplet is determined, for example, by a voltage applied to the individual electrode 35 and a pulse width in addition to the dimension of opening of the nozzles.

Figure 7A:
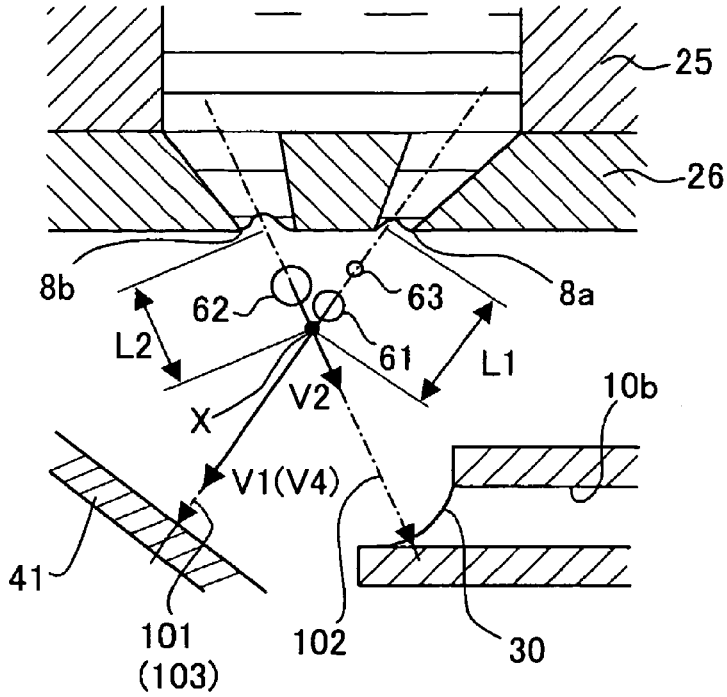
FIG. 7A shows a sectional view illustrating a state of ink droplets ejected from the ink ejecting section shown in FIG. 1 in chronological order.
Figure 7B:
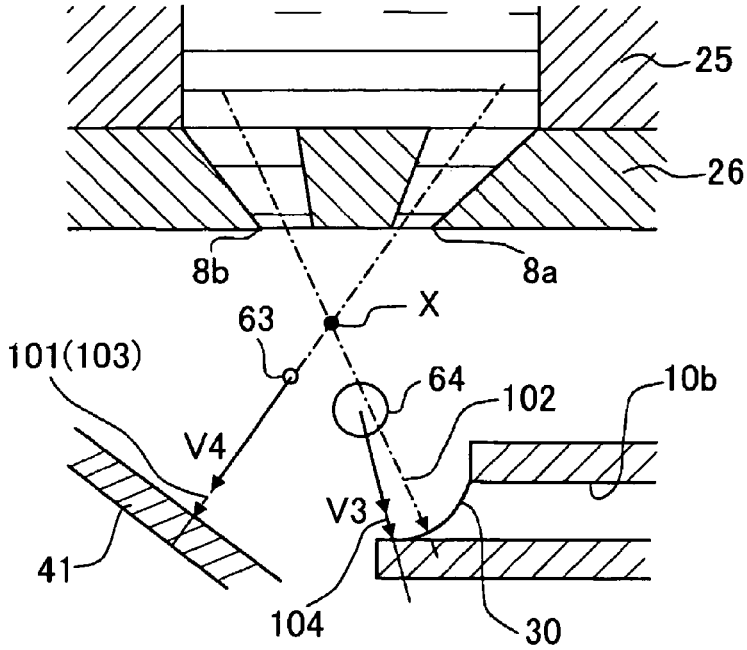
FIG. 7B shows a sectional view illustrating a state of ink droplets ejected from the ink ejecting section shown in FIG. 1 in chronological order.
Figure 7C:
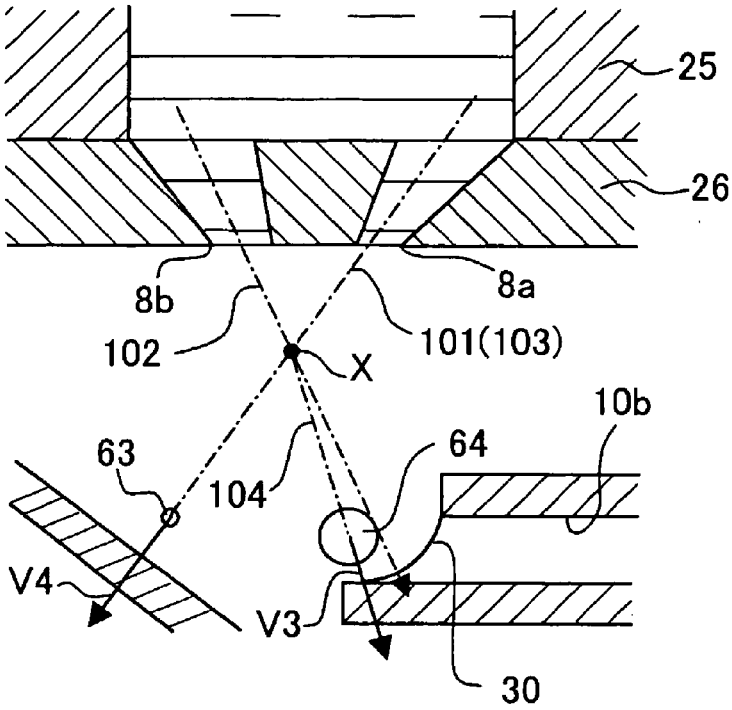
FIG. 7C shows a sectional view illustrating a state of ink droplets ejected from the ink ejecting section shown in FIG. 1 in chronological order.
Figure 7D:
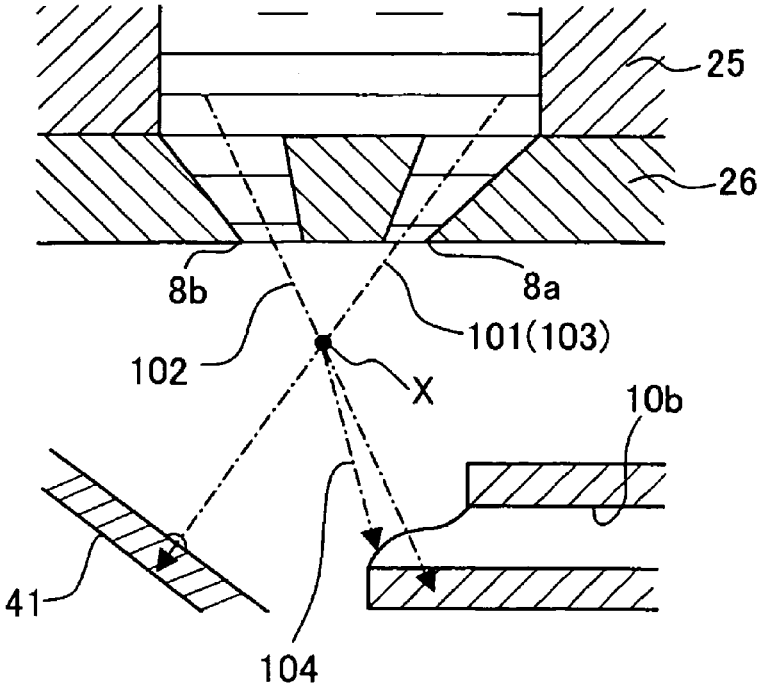
FIG. 7D shows a sectional view illustrating a state of ink droplets ejected from the ink ejecting section shown in FIG. 1 in chronological order.

Next, the operation of ink ejecting section 100 will be explained in detail with reference to FIG. 7 (FIGS. 7A to 7D) showing a sectional view illustrating states of ink droplets being ejected from the ink ejecting section 100 in chronological order. The control device 20 supplies a drive pulse signal to the actuator 21, thereby driving the actuator 21. As shown in FIG. 7A, a main droplet 61 is ejected from the nozzle 8*a* along a trajectory 101 at an ejection speed V1 and a satellite droplet 63 is ejected along a trajectory 103 at an ejection speed V4 slower than the ejection speed V1. At the same time, only a main droplet 62 is ejected from the nozzle 8*b* along a trajectory 102 at an ejection speed V2. As shown in FIG. 7B, the main droplets 61, 62 are collided at an intersection point X to form a united droplet 64. This united droplet 64 flies at a speed V3 along a trajectory 104, which is a new, linear trajectory and is different from the trajectory 101. At this time, the satellite droplet 63 flies after or behind the main droplet 61 which has been ejected from the nozzle 8*a*, and thus the satellite droplet 63 keeps flying at the ejection speed V4 without colliding with the main droplet 62. Then, as shown in FIG. 7C, the united droplet 64 lands on an ink catching section 30 and the satellite droplet 63 lands on a paper 41. Subsequently, as shown in FIG. 7D, the united droplet 64, which has landed on the ink catching section 30, blends with ink held in the ink catching section 30, is sucked up by a capillary ink passage 10*b*, and is delivered to the manifold passage 115 through the capillary ink passage 10*b*. When the satellite droplet 63 has landed on the paper 41, it forms a dot on the paper 41.

According to the first embodiment as explained above, it is possible to eject a satellite droplet 63 having a small volume of 0.002 to 0.5 pl to be landed on the paper 41, thereby making it possible to form a very small dot on the paper 41.

Further, the trajectory 103 of the satellite droplet 63 ejected from the nozzle 8*a* is substantially perpendicular to the paper 41. Accordingly, it is possible to form a circular dot on the paper 41, thereby improving the print quality.

Since the ejection ports of the nozzles 8*a*, 8*b* are formed in a same plane in the nozzle plate 26, it is possible to form the nozzles 8*a*, 8*b* by a simple processing method of drilling through the nozzle 26*a*, thereby reducing the manufacturing cost of the ink-jet head 10.

In addition, the linear distance L1 from the ejection port of the nozzle 8*a* to the intersection point X is longer than the liner distance L2 from the ejection port of the nozzle 8*b* to the intersection point X, and the diameter D1 of the ejection port of nozzle 8*a* is smaller than the diameter D2 of the ejection port of nozzle 8*b*. Further, the relationship of L1/V1=L2/V2 is held in which V1 is the ejection speed of nozzle 8*a* (not less than 4.5 m/sec and less than 7.0 m/sec) and V2 is the ejection speed of nozzle 8*b* (less than 4.5 m/sec). Accordingly, it is possible to eject the desired satellite droplet 63 from the nozzle 8*a*, to eject only the main droplet 62 from the nozzle 8*b*, and to ensure that the main droplets 61 and 62 are collided with each other.

The ink catching section 30 which receives the united droplet 62 is provided to prevent the united droplet 64 from landing on the paper 41. Further, the united droplet 64 received by the ink catching section 30 is supplied to the manifold passage 115 through the capillary ink passage 10*b* to be recycled. Accordingly, the ink is not wasted and the running cost is reduced. Furthermore, since the capillary ink passage 10*b* sucks up the ink by capillary force, it is possible to easily realize the foregoing constitution.

Figure 8A:
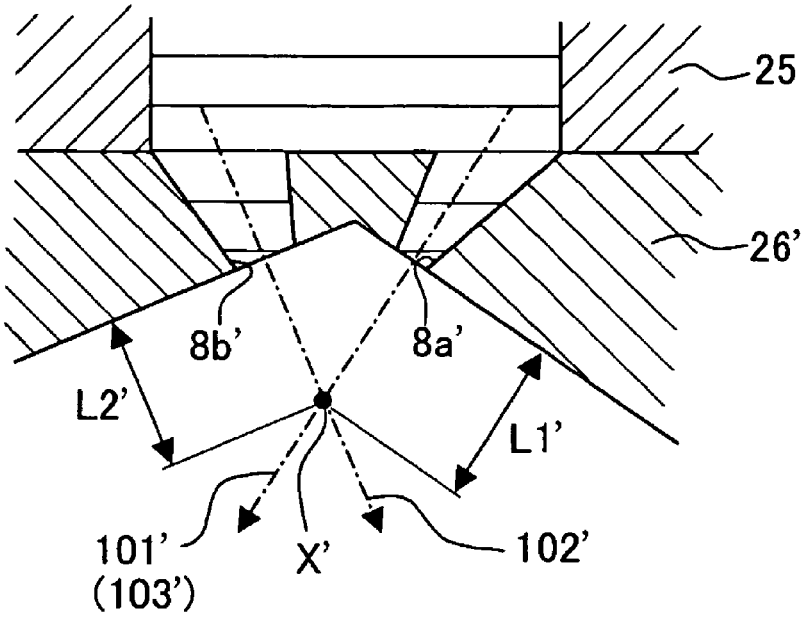
FIGS. 8A and 8B show sectional views illustrating a modification of the nozzles shown in FIG. 2.
Figure 8B:
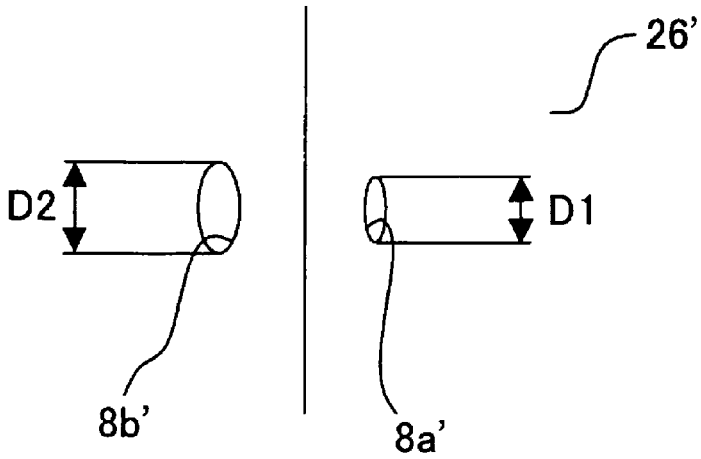

In the first embodiment, although the nozzles 8*a*, 8*b* are constituted so as to be formed in a same plane in the nozzle plate 26, the constitution of the nozzles 8*a*, 8*b* is not limited to such an arrangement. For example, as shown in FIG. 8A, a nozzle plate 26' may be formed so that a perpendicular direction with respect to a plane, in which an ejection port of a nozzle 8*a*' is formed, is along a trajectory 101' of a main droplet 61, and a perpendicular direction with respect to a plane, in which an ejection port of a nozzle 8*b*' is formed, is along a trajectory 102' of a main droplet 63. At this time, the plane of the nozzle 8*a*' is parallel to the paper 41. In addition, the ejection ports of nozzles 8*a*', 8*b*' have a circular shape, and a linear distance L1' from the ejection port of nozzle 8*a*' to the intersection point X', at which the trajectories 101' and 102' intersect with each other, is longer than a linear distance L2' from the ejection port of nozzle 8*b*' to the intersection point X'. Further, as shown in FIG. 8B, a diameter D1' of the nozzle 8*a*' is smaller than a diameter D2' of the nozzle 8*b*'. In other words, a dimension of the ejection port of nozzle 8*a*' is smaller than a dimension of the ejection port of nozzle 8*b*'.

Accordingly, it is possible to form the nozzles 8*a*', 8*b*' so as to stabilize the ejection characteristics and to eject the main droplets 61, 62 and the satellite droplet 63 with high precision.

Next, a second embodiment of the present invention will be explained with reference to the drawings. The second embodiment is same as the first embodiment except for the form of the nozzles. Accordingly, the remaining members or components are denoted with the same reference numerals as those of the first embodiment, omitting the explanation on these members or components.

Figure 9A:
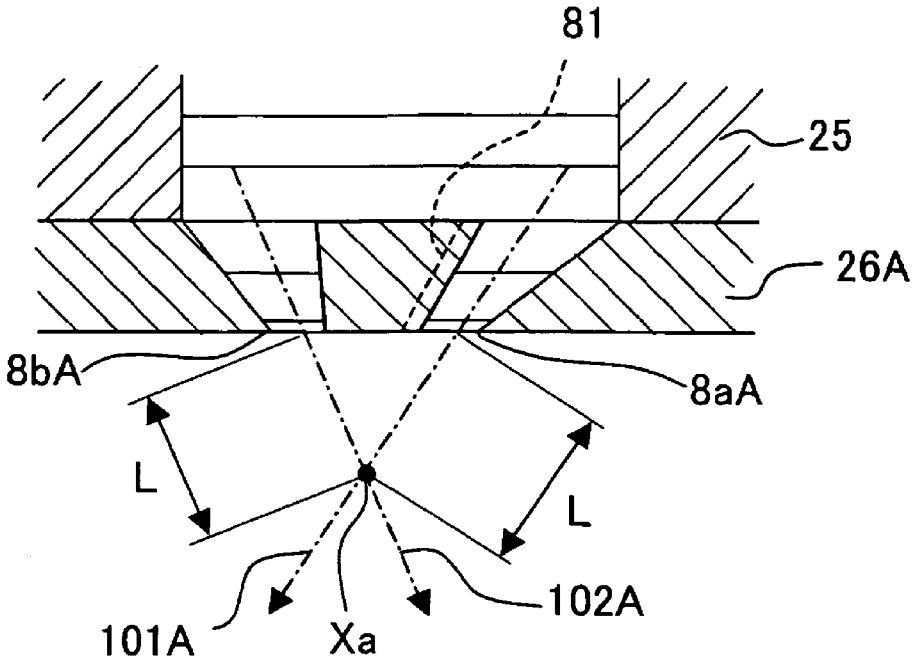
FIGS. 9A and 9B show magnified views of nozzles of an ink ejecting section according to a second embodiment of the present application.
Figure 9B:
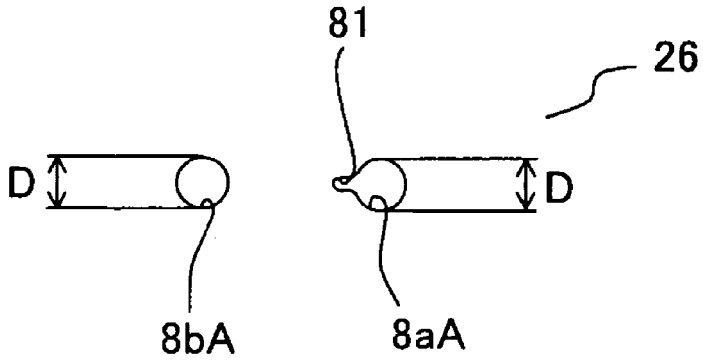

An explanation will be given regarding the arrangement of the nozzles according to the second embodiment with reference to FIG. 9 (FIGS. 9A and 9B) showing a magnified view of nozzles 8*a*A, 8*b*A of an ink ejecting section 10A. FIG. 9A shows a sectional view of the nozzles 8*a*A, 8*b*A, and FIG. 9B shows an outline view of the nozzles 8*a*A, 8*b*A viewed from the ink ejection surface. The nozzles 8*a*A, 8*b*A eject ink droplets on the basis of control of the control device 20.

The control device 20 performs control, in accordance with one ink ejection signal given to the actuator 21, so that the nozzle 8*a*A ejects a main droplet (first main droplet) 61A having a relatively large diameter and a satellite droplet 63A which is smaller in volume than the main droplet 61A (for example, a volume of about 0.002 to 0.5 pl) together with the ejection of the main droplet 61A, and at the same time, the nozzle 8*b*A ejects only one main droplet (second main droplet) 62A, and the main droplet 61A ejected from the nozzle 8*a*A and the main droplet 62A ejected from the nozzle 8*b*A collide with each other to form a united droplet 64A which has a trajectory different from that of the main droplet 61A (see FIG. 11).

The nozzle 8*a*A is formed so that a liner trajectory (first trajectory) 101A is substantially perpendicular to the paper 41. The nozzle 8*b*A is formed so that a liner trajectory (second trajectory) 102A intersects the trajectory 101A at an intersection point XA between the nozzles 8*a*A, 8*b*A and the paper 41 (See FIGS. 11A and 11B).

As shown in FIG. 9A, the ejection port of nozzle 8*a*A and the ejection port of nozzle 8*b*A have a circular shape and are formed in a same plane. Further, a linear distance from the ejection port of nozzle 8*a*A to the intersection point XA and a liner distance from the ejection port of nozzle 8*b*A to the intersection point XA are same (reference numeral "L" in FIG. 9A). In addition, as shown in FIG. 9B, a diameter of the ejection port of nozzle 8*a*A and a diameter of the ejection port of nozzle 8*b*A are same (reference numeral "D" in FIG. 9B). In an outer edge of the ejection port of nozzle 8*a*A, a notched portion 81 is formed extending in a line which connects the nozzles 8*b*A and 8*a*A. Since the dimension of the notched portion 81 is very small, a dimension of an opening of the ejection port of nozzle 8*a*A and a dimension of an opening of the ejection port of nozzle 8*b*A are substantially same, and consequently an ejection speed at which a main droplet is ejected from the nozzle 8*a*A and an ejection speed at which a main droplet is ejected from the nozzle 8*b*A are substantially same. The main droplets 61A, 62A are ejected simultaneously and substantially in a linear trajectory. Consequently, the main droplet ejected from the nozzle 8*a*A and the main droplet ejected from the nozzle 8*b*A collide with each other at the intersection point XA.

Next, an ink ejection operation in the nozzle 8*a*A will be explained with reference to FIG. 10 (FIGS. 10A to 10D) showing a state in which ink droplets are ejected from the nozzle 8*b*A at about 6.0 m/sec. The method for driving the actuator 21 and the ink ejection operation from the nozzle 8*b*A are same as those in the first embodiment, the detailed explanation thereon are omitted.

Figure 10A:
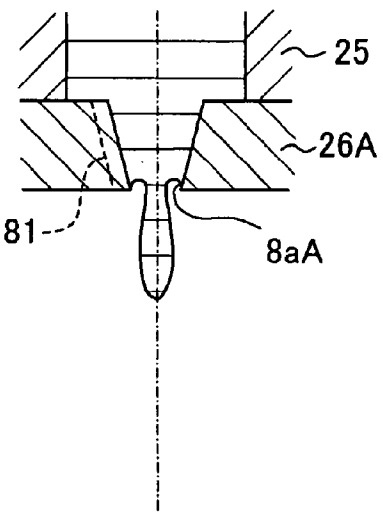
FIGS. 10A to 10D show sectional views illustrating an operation in which ink droplets are ejected from the nozzle shown in FIG. 9.
Figure 10B:
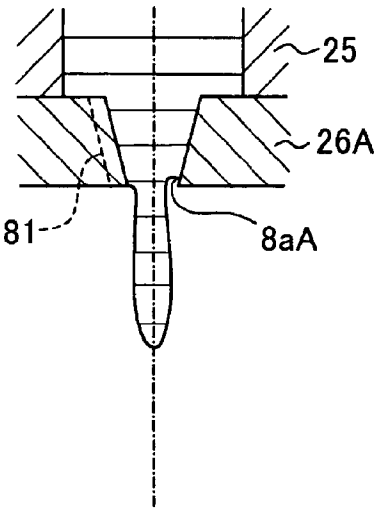
Figure 10C:
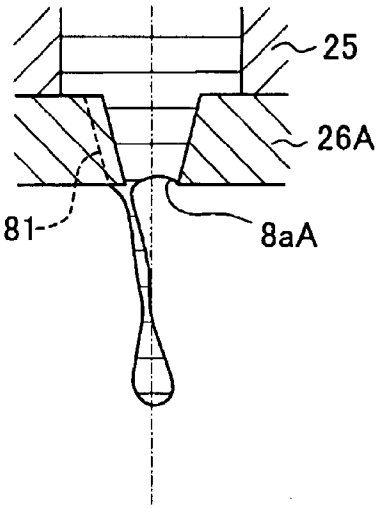
Figure 10D:
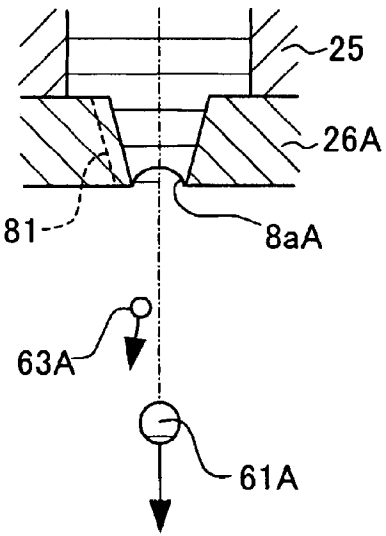

The control device 20 supplies a drive pulse signal to the actuator 21, thereby driving the actuator 21 to begin the ejection of main ink droplet 61A, and ink is pushed out from the nozzle 8*a*A as shown in FIG. 10A. At this time, as shown in FIG. 10B, the ink, which has been pushed out from the nozzle 8*a*A, is pulled slightly toward the notched portion 81. Then, as shown in FIG. 10C, the ink, which is pushed out further, forms an ink droplet in a state with a tailing portion thereof being pulled toward the notched portion 81. Subsequently, as shown in FIG. 10D, the ink droplet, which has been formed in FIG. 10C, is separated into a leading portion and a tailing portion wherein the leading portion forms a main droplet 61A and the tailing portion forms a satellite droplet 63A. The main droplet 61A flies along a trajectory 101A. As for the satellite droplet 63A, due to the force of inertia generated when the tailing portion has been pulled toward the side of the notched portion 81, the satellite droplet 63A flies along a trajectory (third trajectory) 103A which is tilted toward the notched portion 81 as compared with the trajectory 101A (see FIG. 11).

Figure 11A:
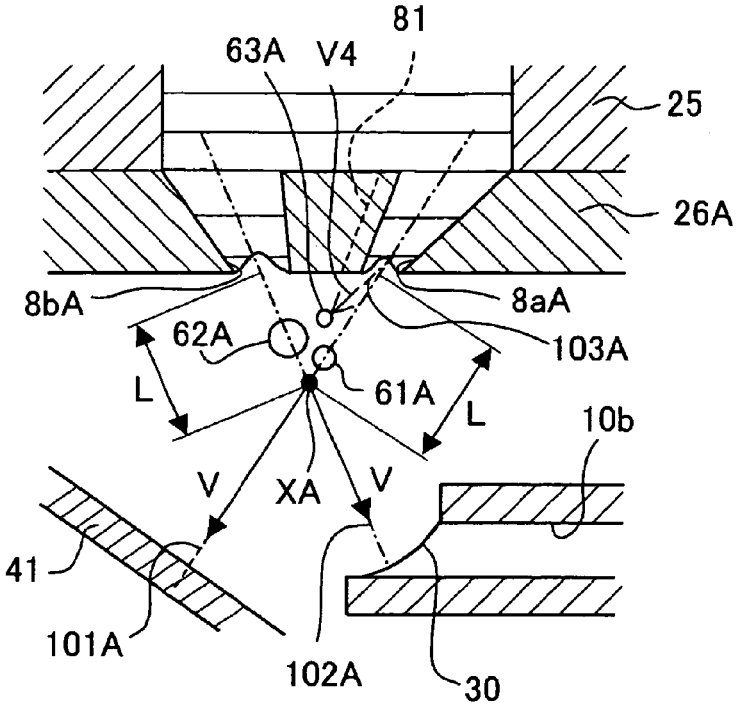
FIG. 11A shows a sectional view illustrating a state of ink droplets ejected from the ink ejecting section shown in FIG. 9 in chronological order.
Figure 11B:
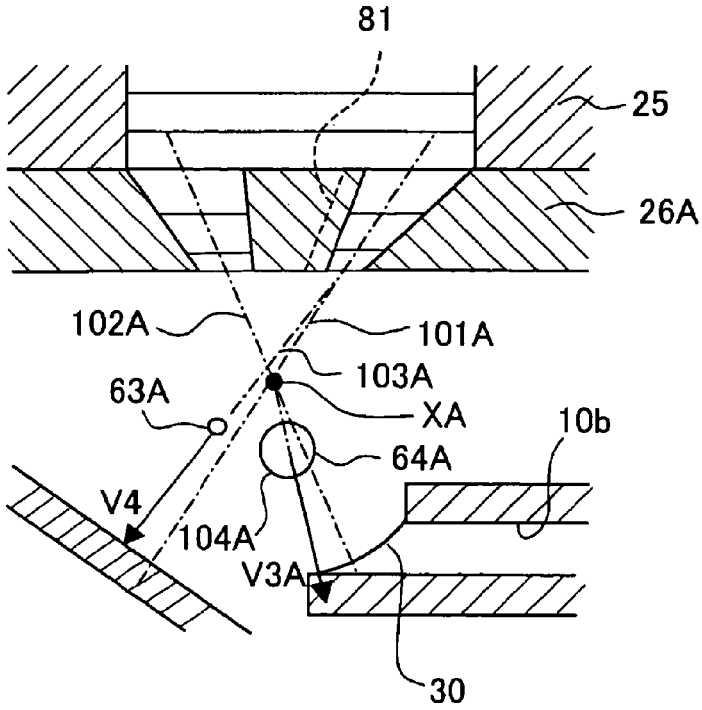
FIG. 11B shows a sectional view illustrating a state of ink droplets ejected from the ink ejecting section shown in FIG. 9 in chronological order.

Next, the operation of the ink ejecting section 100A will be explained in detail with reference to FIG. 11 (FIGS. 11A to 11D) showing a sectional view illustrating states of ink droplets ejected from the ink ejecting section 100A in chronological order. The control device 20 supplies a drive pulse signal to the actuator 21, thereby driving the actuator 21. As shown in FIG. 11A, a main droplet 61A is ejected from the nozzle 8*a*A along a trajectory 101A at an ejection speed V and a satellite droplet 63A is ejected along a trajectory 103A at an ejection speed V4 lower than the ejection speed V. At the same time, only a main droplet 62A is ejected along a trajectory 102A at the ejection speed V. Subsequently, as shown in FIG. 11B, the main droplets 61A and 62A collide with each other at an intersection point XA to form a united droplet 64A. This united droplet 64 flies at an ejection speed V3A along a new linear trajectory 104A which is different from the trajectory 101A.

Figure 11C:
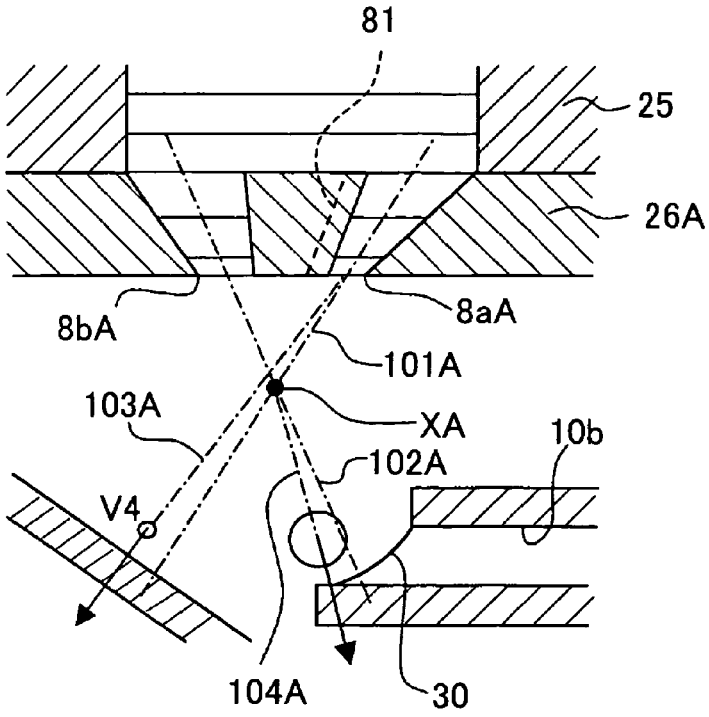
FIG. 11C shows a sectional view illustrating a state of ink droplets ejected from the ink ejecting section shown in FIG. 9 in chronological order.
Figure 11D:
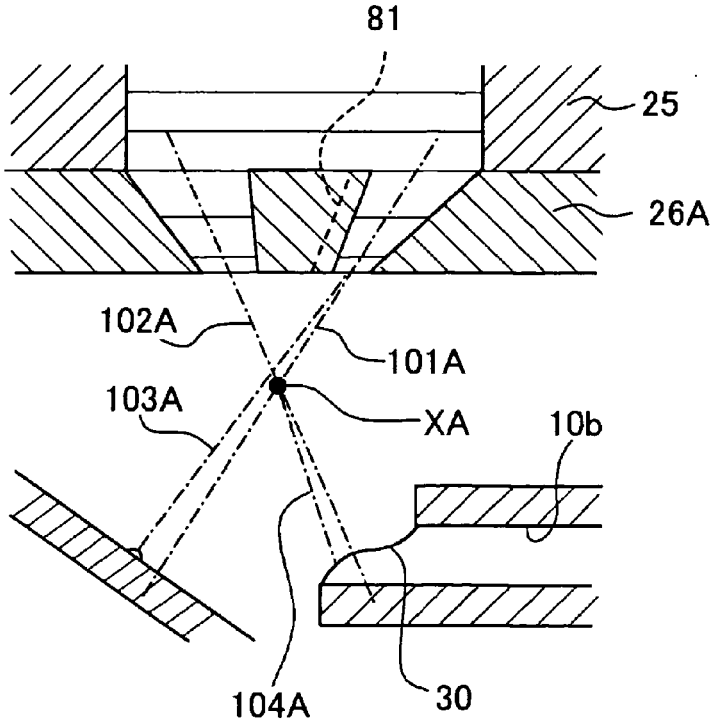
FIG. 11D shows a sectional view illustrating a state of ink droplets ejected from the ink ejecting section shown in FIG. 9 in chronological order.

The satellite droplet 63A does not pass through the intersection point XA because the satellite droplet 63A flies along the trajectory 103A different from the trajectory 101A. Accordingly, the satellite droplet 63A keeps flying at the speed V4 without colliding with the main droplet 62A ejected from the nozzle 8*b*A. Subsequently, as shown in FIG. 11C, the united droplet 64 lands on the ink catching section 30, and the satellite droplet 63A lands on the paper 41. Then, as shown in FIG. 1D, the united droplet 64A, which has landed on the ink catching section 30, blends with ink held in the ink catching section 30, is sucked up by the capillary ink passage 10*b*, and is delivered to the manifold passage 115 from the capillary ink passage 10*b*. The satellite droplet 63, which has landed on the paper 41, becomes a dot on the paper 41.

According to the second embodiment as explained above, it is possible to reliably prevent the satellite droplet 63A from colliding with the main droplet 62A because the satellite droplet 63A will not pass through the intersection point XA due to the presence of the notched portion 81. Accordingly, it is possible to eject the satellite droplet 63A having a small volume of 0.002 to 0.5 pl to be reliably landed on the paper 41.

While the first and second embodiments have been explained and described as above, the present invention is not limited to the foregoing embodiments and many alternatives, modifications and variations in the constitution or design are possible. For example, in the first embodiment, while the trajectory 101 of the main droplet 61 ejected from the nozzle 8*a* and the trajectory 103 of the satellite droplet 63 ejected from 8*a* are perpendicular to the paper 41, these trajectories 101, 103 may be tilted with respect to the paper 41.

Further, while the first embodiment has the constitution using the actuator 21 of unimorph type, the actuator may have constitution of, for example, a stacked type piezoelectric actuator and an electrostatic actuator. In addition, the invention may be applied to an ink-jet head based on the thermal system.

In the first embodiment, the ink-jet head is constituted as a line head. However, the ink-jet head may be a serial head. In this case, the ink-jet head may be controlled so that the ink-jet head reciprocates in a direction perpendicular to a direction in which the paper 41 is transported. With this, it is possible to perform printing on a paper of a larger size with a shorter head.

In addition, in the first and second embodiments, it is arranged so that the united droplets 64, 64A land on the ink catching section 30. However, the ink catching section 30 may be omitted and the united droplet is allowed to land on the paper 41. In this case, the landed united droplet may be used not as information to be recorded (for example, used for background printing or printing on paper margin).

Further, in the first and second embodiments, while an ink is used as the ejection medium, a conductive paste may be used as the ejection medium. Accordingly, it is possible to print a very fine electric circuit pattern. Also, an organic illuminant may be used as the ejection medium, thereby making it possible to make a high-resolution display devices such as an organic electroluminescence display (OELD). Alternatively, it is possible to use an optical resin as the ejection medium to manufacture a micro array lens or a light guide. Other than these, in applications wherein small dots are formed on a print medium, an ejection medium of other type may be used.

Furthermore, in the first and second embodiments, the ejection speed of the satellite droplet is lower than the ejection speed of the main droplet. However, in the recent years, a phenomenon that the ejection speed of the satellite droplet becomes faster than the ejection speed of the main droplet. Such a phenomenon may also be applied to the present invention.

Moreover, in the first and second embodiments, the satellite droplets 63, 63A are ejected from the nozzles 8*a*, 8*a*A, respectively, while no satellite droplet is ejected from the nozzles 8*b*, 8*b*A. However, the present invention is not limited to these constitutions, and the satellite droplet may be ejected also from the nozzle 8*b* (8*b*A). In this case, it is preferable that the catching section 30 is constituted so that the satellite droplet ejected from the nozzle 8*b* (8*b*A) can be caught in the catching section, or a dedicated catching section 30 for catching the satellite droplet ejected from the nozzle 8*b* (8*b*A) is separately provided. Also, control may be performed so that the satellite droplet is ejected prior to the ejection of the main droplet.

What is claimed is:

1. An apparatus for ejecting droplets to form dots on a medium, the apparatus comprising:

an ejection pressure applying section which is a piezoelectric actuator and which applies ejection pressure to a storage chamber which stores liquid;

a first nozzle which communicates with the storage chamber and which ejects a first main droplet in a first trajectory together with a satellite droplet having a volume smaller than the first main droplet;

a second nozzle which communicates with the storage chamber and which ejects a second main droplet in a second trajectory intersecting the first trajectory at a predetermined intersection point;

a control device which controls the ejection pressure applying section, the control device providing a drive pulse signal to the ejection pressure applying section so that the first main droplet and the second main droplet collide with each other at the intersection point to form a united droplet, and the satellite droplet, which has been ejected from the first nozzle, lands on the medium, the piezoelectric actuator applying the ejection pressure to the storage chamber communicating with both of the first nozzle and the second nozzle and being commonly used for the ejections of the first main droplet and the satellite droplet from the first nozzle and the second main droplet from the second nozzle;

a medium holding device which holds the medium; and a droplet catching section which catches the united droplet and which is disposed in a trajectory of the united droplet so that the united droplet does not land on the medium, wherein a following expression is held when the control device drives the ejection pressure applying section:

$L1/V1=L2/V2$, wherein

L1 is a linear distance between an ejection port of the first nozzle and the intersection point;

L2 is a linear distance between an ejection port of the second nozzle and the intersection point;

V1 is an ejection speed of the first main droplet ejected from the first nozzle; and V2 is an ejection speed of the second main droplet ejected from the second nozzle.

2. The apparatus for ejecting droplets according to claim 1, wherein a flying direction of the united droplet is different from a flying direction of the satellite droplet ejected from the first nozzle.

3. The apparatus for ejecting droplets according to claim 1, wherein a volume of the satellite droplet is 0.002 to 0.5 pl.

4. The apparatus for ejecting droplets according to claim 1, wherein the first trajectory is perpendicular to a surface of the medium held in the medium holding device.

5. The apparatus for ejecting droplets according to claim 1, wherein the ejection port of the first nozzle and the ejection port of the second nozzle are formed in a same plane.

6. The apparatus for ejecting droplets according to claim 1, wherein:

a first plane in which the ejection port of the first nozzle is formed and a second plane in which the second nozzle is formed are planes intersecting with each other; and the first nozzle is formed so that an axis line of the first nozzle extends along the first trajectory, and the second nozzle is formed so that an axis line of the second nozzle extends along the second trajectory.

7. The apparatus for ejecting droplets according to claim 1, wherein a nozzle diameter of the first nozzle at the ejection port thereof and a nozzle diameter of the second nozzle at the ejection port thereof are different.

8. The apparatus for ejecting droplets according to claim 1, wherein a nozzle diameter of the first nozzle at the ejection port thereof is smaller than a nozzle diameter of the second nozzle at the ejection port thereof; and a linear distance between the ejection port of the first nozzle and the intersection point is longer than a linear distance between the ejection port of the second nozzle and the intersection point.

9. The apparatus for ejecting droplets according to claim 1, wherein:

an ejection speed of the first main droplet ejected from the first nozzle is not less than 4.5 m/sec and less than 7.0 m/sec; and an ejection speed of the second main droplet ejected from the second nozzle is less than 4.5 m/sec.

10. The apparatus for ejecting droplets according to claim 1, wherein:

the ejection port of the first nozzle has a circular or elliptic shape; and a trajectory of the satellite droplet is same as the first trajectory.

11. The apparatus for ejecting droplets according to claim 1, wherein:

the ejection port of the first nozzle has a circular or elliptic shape in which a notch is formed in a portion of outer edge thereof; and a trajectory of the satellite droplet is tilted toward the notch from the first trajectory.

12. The apparatus for ejecting droplets according to claim 1, further comprising a discharge passage for discharging the united droplet which has been caught in the droplet catching section.

13. The apparatus for ejecting droplets according to claim 1, further comprising:

a liquid chamber for supplying the liquid to the storage chamber; and a delivery passage for delivering the united droplet which has been caught in the droplet catching section to the liquid chamber.

14. The apparatus for ejecting droplets according to claim 13, wherein the delivery passage sucks up the united droplet to the liquid chamber by capillary force.

15. The apparatus for ejecting droplets according to claim 1, wherein the first main droplet and the satellite droplet are formed when ink is ejected from the first nozzle and the second main droplet is formed when ink is ejected from the second nozzle.

16. An apparatus for ejecting droplets to form dots on a medium, the apparatus comprising:

an ejection pressure applying section which is a piezoelectric actuator and which applies ejection pressure to a storage chamber which stores liquid;

a first nozzle which communicates with the storage chamber and which ejects a first main droplet in a first trajectory;

a second nozzle which communicates with the storage chamber and which ejects a second main droplet in a second trajectory intersecting the first trajectory at a predetermined intersection point;

a control device which provides a drive pulse signal to the ejection pressure applying section so as to eject from the first nozzle the first main droplet and a satellite droplet which has a volume smaller than the first main droplet and which flies apart from the first main droplet; and to eject from the second nozzle the second main droplet which collides with the first main droplet at the intersection point to form a united droplet, the piezoelectric actuator applying the ejection pressure to the storage chamber communicating with both of the first nozzle and the second nozzle and being commonly used for the ejections of the first main droplet and the satellite droplet from the first nozzle and the second main droplet from the second nozzle;

a print medium holding device which holds the medium at a position intersecting a trajectory of the satellite droplet; and a droplet catching section which catches the united droplet and which is disposed in a trajectory of the united droplet so that the united droplet does not land on the medium, wherein a following expression is held when the control device drives the ejection pressure applying section:

$L1/V1=L2/V2$, wherein

L1 is a linear distance between an ejection port of the first nozzle and the intersection point;

L2 is a linear distance between an ejection port of the second nozzle and the intersection point;

V1 is an ejection speed of the first main droplet ejected from the first nozzle; and V2 is an ejection speed of the second main droplet ejected from the second nozzle.

* * * * *